US006471530B1

(12) United States Patent
Gimbatti et al.

(10) Patent No.: US 6,471,530 B1
(45) Date of Patent: Oct. 29, 2002

(54) PLUG-AND-SOCKET CONNECTION FOR WATER-COOLED, CURRENT-BEARING LINES FOR TOOLS

(75) Inventors: Michel Gimbatti, Huningue (FR); Michel Bremont, Attenschwiller (FR); Thomas Lubert, Berlin (DE); Christian Tischmacher, Grentzingen (FR); Yannick Nurdin, Blotzheim (FR); Christian Hengel, Hochstatt (FR)

(73) Assignee: A. Raymond & Cie (FR)

( * ) Notice: Subject to any disclaimer, the term of this patent is extended or adjusted under 35 U.S.C. 154(b) by 0 days.

(21) Appl. No.: 09/958,234

(22) PCT Filed: Mar. 25, 2000

(86) PCT No.: PCT/EP00/02649

§ 371 (c)(1),
(2), (4) Date: Oct. 5, 2001

(87) PCT Pub. No.: WO00/64011

PCT Pub. Date: Oct. 26, 2000

(30) Foreign Application Priority Data

Apr. 15, 1999 (DE) ..... 199 16 984

(51) Int. Cl.[7] ..... H01R 4/60
(52) U.S. Cl. ..... 439/196; 439/485
(58) Field of Search ..... 439/196, 485

(56) References Cited

U.S. PATENT DOCUMENTS 4,223,969 A * 9/1980 Gatturna ..... 439/194
5,015,202 A * 5/1991 Blumentritt et al. ..... 439/487
5,197,895 A * 3/1993 Stupecky ..... 439/194
5,229,543 A * 7/1993 Strefling ..... 174/15.6

FOREIGN PATENT DOCUMENTS

DE 39 36 928 A 1 * 8/1991

* cited by examiner

*Primary Examiner*—Gary F. Paumen
*Assistant Examiner*—Ann McCamey
(74) *Attorney, Agent, or Firm*—Gifford, Krass, Groh, Sprinkle, Anderson & Citkowski, P.C.

(57) ABSTRACT

A plug-and-socket connection for water-cooled, current-bearing lines, in particular, to bipolar, high-frequency current conductors for the induction heating of tools is provided. The plug-and-socket connection allows both the electric circuit for the power supply and the circuit for the cooling water to be rapidly and easily closed by hand, or to be interrupted, for example, for maintenance work. The plug-and-socket connection includes a female element and a male element which contain chambers and ducts opening into the chambers that supply the cooling water. The ducts come into contact with one another when the plug-and-socket connection is in the interconnected position. The chambers are in direct contact with the water tubes, which are provided for supplying the cooling water. The backflow of cooling water occurs via a direct connection between a water tube which supplies the male element with cooling water and another water tube which conveys the cooling water away from the female element. Two contact sockets of an electrical plug-and-socket connection are also fixed in the female element, whilst two contact pins which mate with the contact sockets are fixed in the male element. The contact sockets and contact pins are connected to electrical lines for the power supply. The lines are in turn guided through the water tubes.

29 Claims, 4 Drawing Sheets

PLUG-AND-SOCKET CONNECTION FOR WATER-COOLED, CURRENT-BEARING LINES FOR TOOLS

BACKGROUND

The invention pertains generally to a plug-and-socket connection for water-cooled, current-carrying lines, in particular, for bipolar high-frequency current conductors for the induction heating of tools.

In various industrial branches, the induction energy produced by an alternating current flowing through induction coils is used for heating electrically conductive components or ferromagnetic components. One such example is an induction welding torch. When using inductive heating, it is usually required to continuously cool the current-bearing lines in order to prevent overheating during operation of the respective device. In addition to air cooling systems, water cooling systems are also utilized quite frequently for this purpose.

There also exist automated tools, or tools actuated with the aid of robots, which contain current-bearing lines that need to be continuously cooled, preferably with water, during operation of the tool.

For example, a tool for automatically placing fastening bolts on supporting surfaces is described in DE 196 38 521 and in the corresponding PCT publication WO 98/12016. Each fastening bolt to be processed consists of a bolt shaft, one end of which is rigidly connected to a disk plate. The end face of the disk plate is coated with a dry hot-melt adhesive that can be reactivated under the influence of heat. The fastening bolts are fed to the tool from a stockpile via a separating device through a laterally extending supply channel. When the tool is actuated, the fastening bolts are individually transported to the mouthpiece from a standby position in such a way that the end face of the disk plate that carries the hot-melt adhesive points forward. The bolt shaft of the fastening bolt can be simultaneously gripped by a pneumatically actuated plunger, centered and placed under pressure when the mouthpiece of the tool is pressed flat against a supporting surface to which the fastening bolts should be bonded. An induction coil is accommodated in the mouthpiece of the tool which surrounds the fastening bolt and, in particular, its disk plate. While the pneumatically actuated plunger presses the fastening bolt against the supporting surface, this induction coil is supplied with a relatively intense high-frequency alternating current. This causes an alternating magnetic field to be generated that also penetrates the fastening bolts and inductively heats the fastening bolt, and in particular, its disk plate, very rapidly such that the layer of hot-melt adhesive on it melts, i.e., reactivates. The connection between the disk plate of the fastening bolts and the supporting surfaces is produced once the hot-melt adhesive again solidifies. The lines that conduct the intense high-frequency induction current need to be continuously cooled with water during operation of this device.

In a tool of this type, it is unavoidable that after a certain operating time, adhesive buildup occurs, in particular, in the vicinity of the mouthpiece, that ultimately makes it necessary to replace the tool. In addition, these tools usually require maintenance at regular intervals, e.g., in order to remove lime deposits from the lines that convey the cooling water. Until now, this always required the disassembly and maintenance of the entire tool, or replacement of the tool with another tool. Accordingly, these maintenance procedures are expensive and time-consuming. Supply of the cooling water and high-frequency alternating current are realized in the form of spatially separated connections, or bulky connection boxes are used that contain the necessary connections and have an excessive space requirement. When it is necessary to perform maintenance or to replace certain components, time-consuming and complicated procedures are frequently required that utilize special wrenches. If tools of this type are used in automated production lines, the production sequence on the entire production line needs to be interrupted for the time-consuming procedure of replacing the tool or performing the required maintenance work.

In previous attempts to simplify and accelerate the replacement of such tools and, if possible, to limit tool replacement to certain parts of the respective tool, the water-cooled current conductors of the induction coils present a particular challenge because they need to satisfy stringent requirements with respect to tightness and disruptive strength. In addition, such tools should also have a high impact strength against external mechanical influences and be able to withstand intense temperature fluctuations without developing functional defects. Thus, there is a need in the art for a plug-and-socket connection provided on the tool that can survive multiple tool replacements.

SUMMARY OF THE INVENTION

Accordingly, the present invention is a plug-and-socket connection for water-cooled, current-bearing lines for tools and, in particular, automated tools. The plug-and-socket connection is able to concentrate the energy exchange of the induction generator on the inductor and can be rapidly and easily actuated. In addition, the plug-and-socket connection satisfies predetermined requirements with respect to safety, tightness and electrical disruptive strength.

The plug-and-socket connection includes a chamber, and ducts for the incoming cooling water which open into this chamber, and are respectively provided in the housing of the female element and in the housing of the male element of the plug-and-socket connection. The ducts are connected to one another in the interconnected state of the plug-and-socket connection, and the chambers are directly connected to a water tube that supplies and conveys away the cooling water. The backflow of the cooling water occurs via a direct connection between a water tube that supplies the cooling water to the male element of the plug-and-socket connection and a water tube that conveys the cooling water away from the female element, such that the direct connection bypasses their respective chambers. The plug-and-socket connection includes two contact sockets of an electric bipolar plug-and-socket connection mounted in the housing of the female element in bores provided adjacent to the ducts. The contact pins of the electric bipolar plug-and-socket connection, which project from the end face of the housing and correspond to the contact sockets, are mounted in the housing of the male element in bores provided adjacent to the ducts. The electric lines for the power supply are connected to the contact sockets and the contact pins, respectively, and are guided through the water tubes connected to the chambers that supply and convey away the cooling water.

Advantageously, a plug-and-socket connection is provided which makes it possible to simultaneously close or open the electric circuit for supplying power to an induction coil and the cooling water circuit. Another advantage of the present invention is that maintenance work on the corresponding tools or the replacement of a tool or parts thereof can consequently be carried out much more easily and quickly. Still another advantage of the plug-and-socket connection is that an ideal transport of the coolant for the current conductors along two separate paths is ensured. Yet another advantage is that the two poles lie close to one another such that damaging parasitic fields are minimized. Still yet another advantage is that coolant is utilized for cooling the electric plug-and-socket connection in order to minimize the thermal stress.

A further advantage of the present invention is that the incoming cooling water flows around the electric lines and through the ducts provided in the housing, as well as through the chambers. Consequently, the electric plug-and-socket connections arranged in the housing are also cooled before the cooling water is conveyed away in order to cool the induction coil. Still a further advantage of the present invention is that since the chambers and ducts provided for cooling purposes are bypassed during the backflow, the cooling water backflow cannot mix with the incoming cooling water in the plug-and-socket connection, and is able to cool off again rapidly.

According to one preferred embodiment of the invention, the chamber in the female element and that in the male element are respectively formed by a pot-shaped recess in the housing that is sealed toward the outside by a closure piece that seals the housing wall; this closure piece contains two openings, into which two metal sleeves are inserted in a sealed fashion. The shorter metal sleeve opens into the chamber and the longer metal sleeve extends through the chamber and into a bore in the housing section situated adjacent to the chamber that is aligned with the opening in question. Tubes for the supply and backflow of the cooling water are pushed onto the ends of the metal sleeves that project from the closure piece, and are secured thereon by means of clamps.

In the female element, the longer metal sleeve extends into the inner bore section of the aligned bore, which is defined by a step. In the male element, the longer metal sleeve projects a certain distance from the smooth, continuous bore; when interconnecting the plug-and-socket connection, this projecting end fits into the outer bore section of the aligned bore in the female element, which is defined by a step, and is sealed therein relative to the wall by a ring seal.

Integrally formed onto the housing of the male element is a tubular projection that extends by a short distance beyond the end of the metal sleeve that projects from the end face and the contact pins that also project from the end face. When interconnecting the plug-and-socket connection, this tubular projection fits over the end section of the female element housing that faces away from the closure piece, and is sealed relative to this end section of the housing by means of ring seals. Advantageously, reliable connection between the female element and the male element of the plug-and-socket connection is thus achieved.

Three ducts for the incoming cooling water are offset relative to one another by 120°, and are preferably provided in the housing of the male element and of the female element, with the ducts in the female element being aligned with the ducts in the male element in the interconnected state of the plug-and-socket connection. Two bores for the electrical contact sockets and for the electrical contact pins, which are also offset relative to one another by 120°, and one bore for the connections of the water backflow are respectively provided between the ducts. Advantageously, superior cooling of the electric lines and the connections is achievable.

The electric lines that are guided inside, respectively, the water tubes that supply and convey away the cooling water and the shorter metal sleeves that open into the chambers, preferably consist of six wires that are divided into two groups of three wires each which are respectively connected to the contact sockets and to the contact pins at the level of the chambers of the female element and of the male element.

It should be appreciated that the connection between the female element and the male element may be secured with a retaining ring that contains a bayonet lock or screw-type lock.

According to one preferred embodiment, a mounting ring is fitted into an annular groove on the periphery of the housing of the male element and of the female element, respectively, with the mounting rings making it possible to securely mount both elements on carrier plates.

Other features and advantages of the present invention will be readily appreciated, as the same becomes better understood after reading the subsequent description taken in conjunction with the accompanying drawings.

DESCRIPTION OF THE PREFERRED EMBODIMENTS

Figure 1:
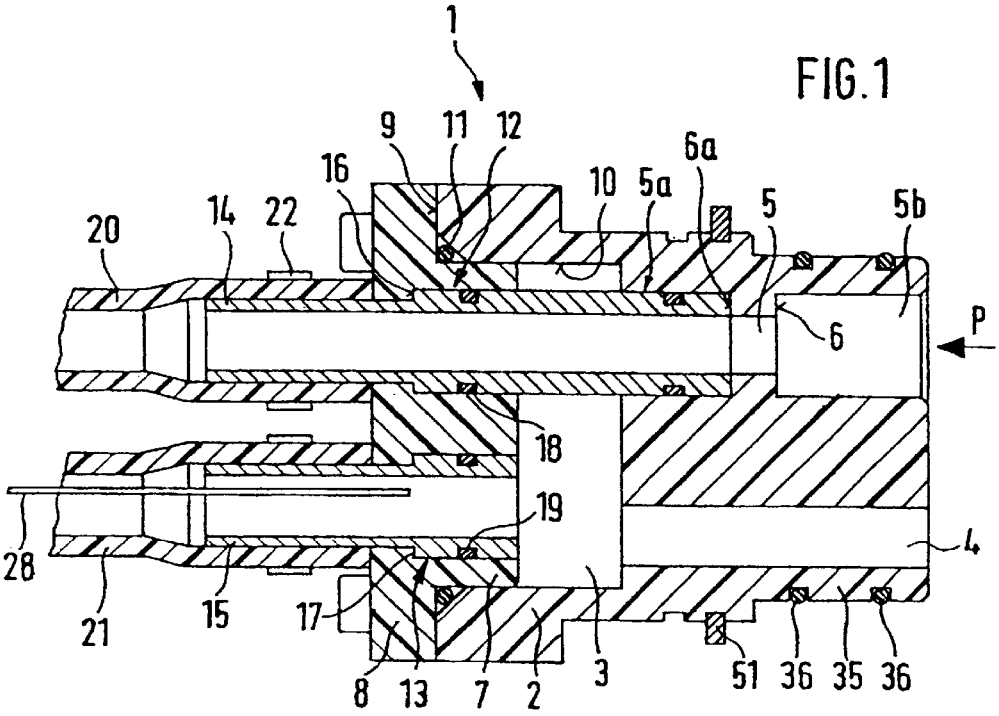
FIG. 1 is a longitudinal section through the female element of the plug-and-socket connection according to the present invention.

FIG. 1 shows a longitudinal section through the female element 1 of a plug-and-socket connection for fluid-cooled, current-bearing lines, and in particular, water-cooled, current-bearing lines. This female element consists of a housing 2 that is preferably manufactured from plastic, e.g., polyamide, with passages for the cooling fluid, which in this example is water and lead-throughs for the electric lines 28 being formed in the housing by means of stepped bores and hollow spaces. The housing 2 contains a pot-shaped chamber 3 that extends up to approximately half its depth. The housing 2 also contains three tubular ducts 4 that are offset relative to one another by an angle of 120°, and extend from the base of the pot-shaped chamber through the other (solid) half of the housing 2 (see also FIG. 3). In addition, a continuous bore 5 is arranged between the two upper ducts 4. The interior of the continuous bore S contains a step 6, 6*a* in both directions respectively, of identical size. such that two approximately identical sections 5*a* and 5*b* of the bore 5 are formed.

The chamber 3 is covered by a closure piece 7, having a projecting collar 8, that is screwed against the annular surface 9 of the housing wall 10. The closure piece 7 is sealed relative to the housing wall 10 by means of a ring seal 11. The closure piece 7 contains two continuous round openings 12, 13, one of which 12 is aligned with the bore 5 and bore sections 5*a*, 5*b*, respectively in the housing 2. A metal sleeve 14, 15, preferably made of a copper alloy, is inserted into each of the openings 12, 13, respectively. The metal sleeves are held within the openings 12, 13 by steps 16, 17 and sealed relative to the wall of the opening 12, 13 by means of ring seals 18, 19.

One end of both metal sleeves 14, 15 projects from the closure piece 7 to such a degree that tubes 20, 21 for supplying and conveying away cooling water can be pushed onto the aforementioned ends and secured to them with clamps 22. The metal sleeve 15 which forms the connection for the hose 21 that supplies the cooling water to an induction coil (not shown) ends flush with the closure piece 7 in the interior. However, the other metal sleeve 14 is extended such that it passes through the chamber 3 into the section 5*a* of the aligned bore 5 in the housing 2, and contacts the step 6*a*. The section 5*b* of the bore 5 serves to connect the line that conveys the cooling water backflow between the male element 1' and the female element 1 of the plug-and-socket connection, as is described in greater detail below.

Figure 3:
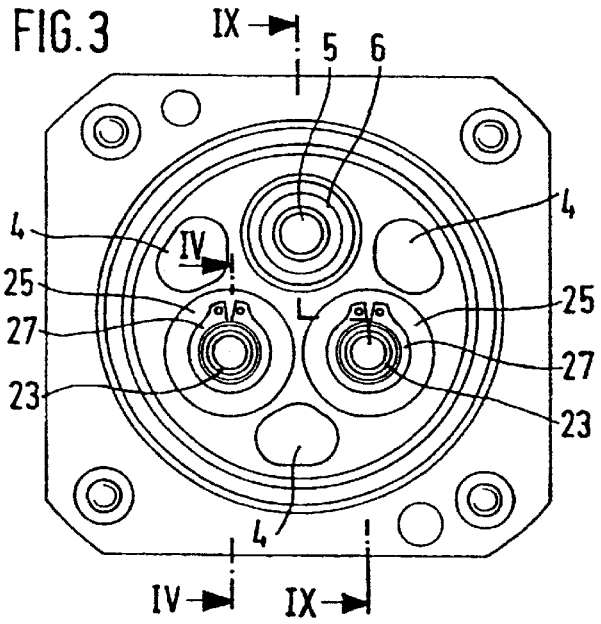
FIG. 3 is a view of the female element of the plug-and-socket connection according to the present invention in the direction of arrow P in FIG. 1.

Referring to FIG. 3, two additional continuous bores 24, i.e., bores that open into the chamber 3 are illustrated. The additional continuous bores 24 are arranged in the (solid) section of the housing 2 situated adjacent to the recess [sic] 3, such that these bores are respectively offset by 120° with reference to the bore 5. The contact sockets 23 of a bipolar electric plug-and-socket connection are secured onto steps 25 in these bores by means of a collar 26 and a Seeger circlip ring 27 (see also FIG. 4), or other suitable means. The electric lines 28 that serve to supply the induction coil with a high-frequency alternating current, not shown, are connected to the contact sockets 23 by either soldering or by crimp connections 29. The electric lines extend through the metal sleeve 15 that opens into the chamber 3, and through the coolant tube 21 connected thereto.

Figure 4:
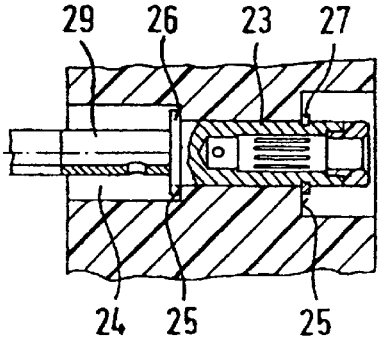
FIG. 4 is a longitudinal section through a detail of the female element along the line IV—IV in FIG. 3, with the longitudinal section extending in front of or behind the plane of the section shown in FIG. 1.
Figure 2:
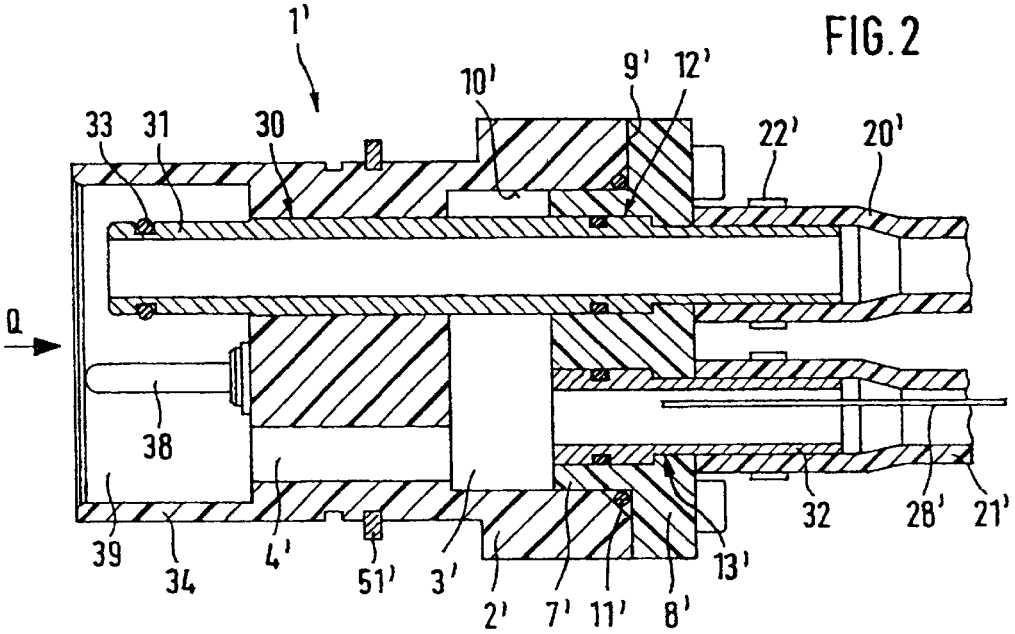
FIG. 2 is a longitudinal section through the male element of the plug-and-socket connection according to the present invention.
Figure 6:
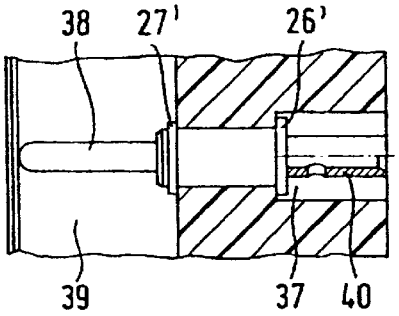
FIG. 6 is a longitudinal section through a detail of the male element along the lines VI—VI in FIG. 5, with the longitudinal section extending in front of or behind the plane of the section shown in FIG. 2.
Figure 5:
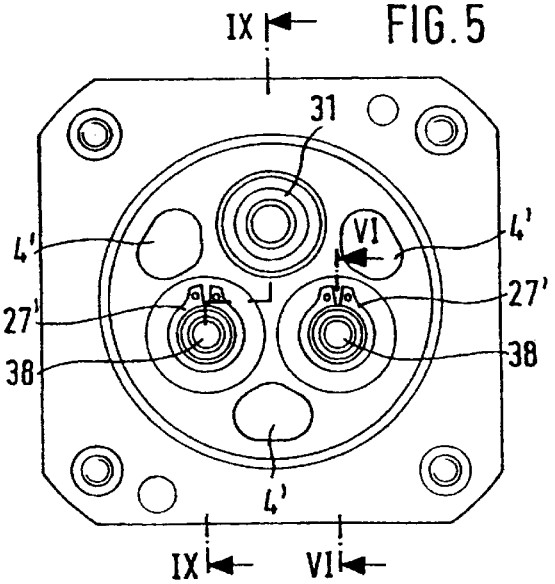
FIG. 5 is a view of the male element of the plug-and-socket connection according to the present invention in the direction of the arrow Q in FIG. 2.

The male element 1' of the plug-and-socket connection is illustrated in FIGS. 2, 5 and 6, and is analogous to the female element 1 shown in FIGS. 1, 3 and 4. The male element is essentially the mirror-image of the female element. Therefore, identical components are identified by the same reference symbols only with an apostrophe.

The housing 2' of the male element 1' also contains a pot-shaped chamber 3' in one of its halves. The housing 2' includes three ducts 4' for the cooling waters which are respectively offset relative to one another by 120°, extending from the base of the chamber through the other half of the housing 2' (see also FIG. 5). Preferably, the ducts are arranged in such a way that, in the interconnected state of the plug-and-socket connection, they are aligned with the ducts 4 in the female element 1. A smooth, continuous bore 30 is arranged between two ducts 4'. This bore is aligned, in the interconnected state of the plug-and-socket connection such that the section 5*b* of the bore 5 in the female element 1 is open toward the outside.

The housing 2' includes a closure piece 7', which is in turn screwed against the annular surface 9' of the housing 2', closing off the housing wall 10'. The closure piece is sealed relative to the housing wall 10' by means of a ring seal 11'. The closure piece 7' also contains the two openings 12', 13', with one opening 12' being aligned with the bore 30. Two metal sleeves 31, 32 are pushed into the openings 12', 13' in a sealed fashion. Tubes 20' and 21' for supplying and conveying away the cooling water are coupled onto the ends of the metal sleeves that project out of the closure piece 7', and secured by means of clamps 22'.

The shorter metal sleeve 32 in the opening 13' ends flush with the closure piece 7' in the interior such that the cooling water passage defined by the metal sleeve 32 opens into the chamber 3'. The longer metal sleeve 31 in the opening 12' extends through the chamber 3', as well as through the bore 30 that is aligned with the opening 12', and projects a certain distance from the bore 30. The end of the metal sleeve 31 that projects from the bore 30 is provided with a ring seal 33 inserted into an annular groove, i.e., this end fits in a sealed fashion into the section 5*b* of the bore 5 in the female element 1 (see also FIG. 7).

Figure 7:
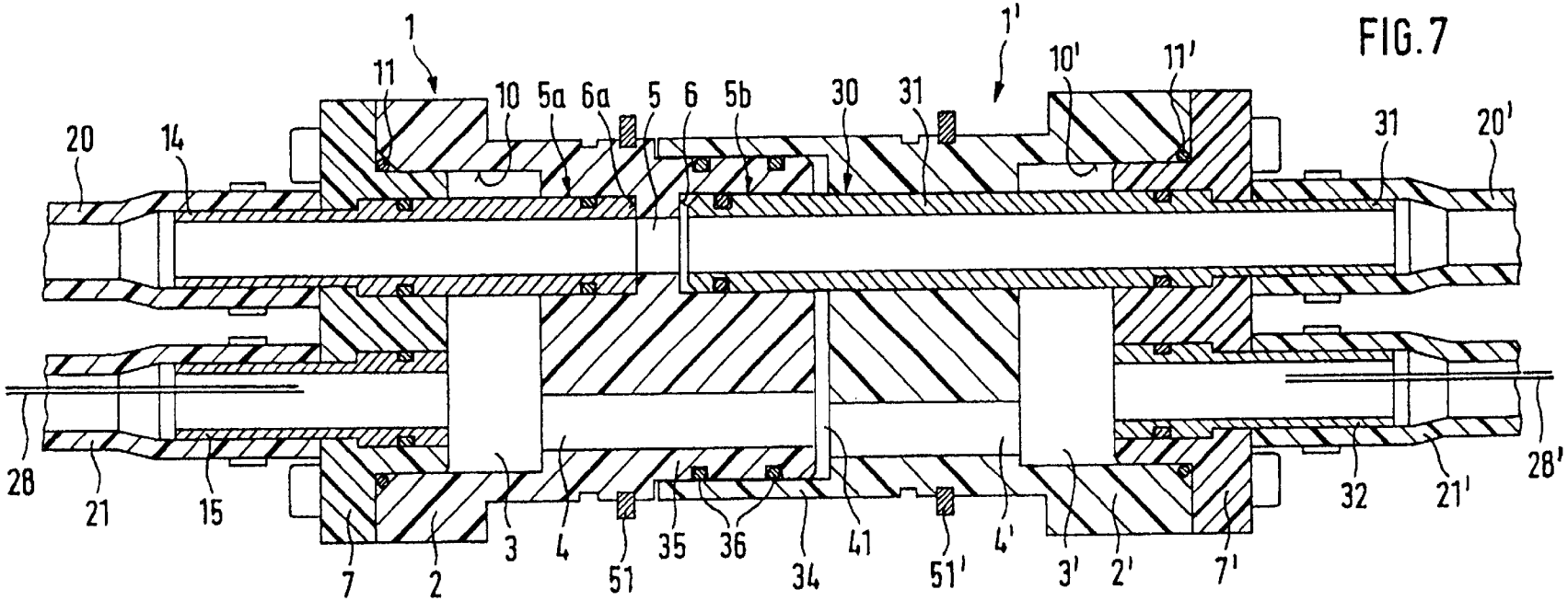
FIG. 7 is a longitudinal section through the plug-and-socket connection according to the present invention, in which the elements according to FIGS. 1 and 2 are interconnected.

The housing 2' contains the tubular projection 34 that projects a short distance beyond the end of the metal sleeve 31. This tubular projection fits over the end section 35 which faces away from the closure piece 7 of the housing 2 of the female element 1. In this case, the outer surface of the end section 35 of the housing 2 is sealed relative to the inner surface of the tubular projection 34 of the housing 2' by means of ring seals 36. It should be appreciated that in the interconnected state of the plug-and-socket connection, a gap 41 of approximately 2 mm remains between the opposing surfaces of both elements, as shown in FIG. 7.

Two contact pins 38 that correspond to the contact sockets 23 in the female element 1 are secured in continuous bores 37 in the male element 1' by means of a collar 26' and a Seeger circlip ring 27' such that they are offset relative to the bore 30 by 120° (see FIGS. 5 and 6). These two contact pins extend through the space 39 that is surrounded by the tubular projection 34. The electric lines 28' for supplying the induction coil with power, which extend through the cooling water tube 21', the short metal sleeve 32 and the chamber 3', are joined to these contact pins by a joining means such as by soldering or by crimp connections 40.

The plug-and-socket connection is preferably arranged between the power generator and a coaxial transformer of the power supply, and the electric lines 28, 28' are, as mentioned previously, respectively guided inside of the tubes 21, 21' of the cooling water circuit; however, they may also be embedded in the walls of the tubes 21, 21'. These lines preferably consist of six wires that each have a cross section of 0.5 $mm^2$. At the level of the plug-and-socket connection or within the chamber 3, 3' of the female element 1 and male element 1', these wires are divided into two groups of three wires each that are connected to the contact sockets 23 in the female element 1, or to the contact pins 38 in the male element 1'.

Figure 8:
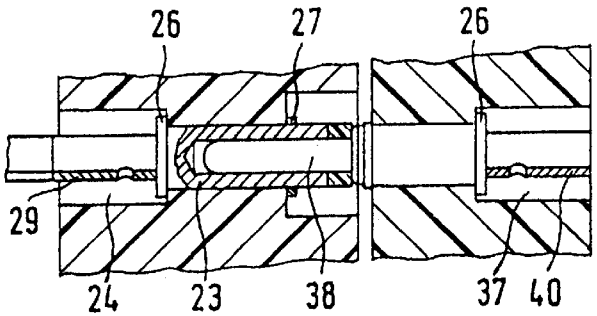
FIG. 8 is a longitudinal section through the corresponding details of the plug-and-socket connection in the interconnected state, with the longitudinal section extending in front of or behind the plane of the section shown in FIG. 7.
Figure 9:
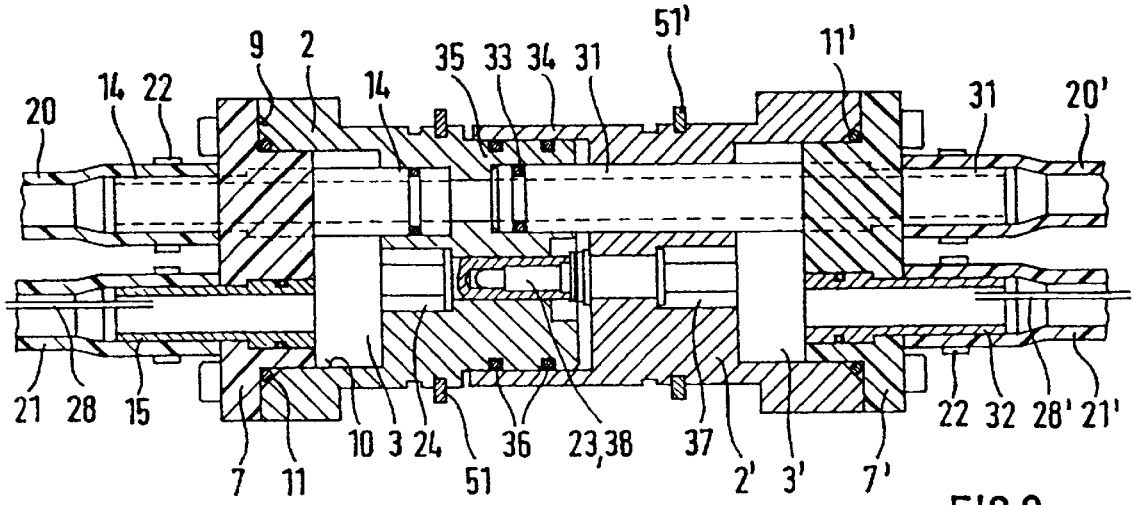
FIG. 9 is a longitudinal section through the plug-and-socket connection in the interconnected state along the angled line of section IX—IX in FIGS. 3 and 5.

In operation, the two elements of the described plug-and-socket connection are interconnected in order for the tool to function. The contact pins 38 form an electric contact with the contact sockets 23, which closely and elastically receive the contact pins 38. In addition, a cooling water circuit that is completely sealed toward the outside is completed (see FIGS. 7, 8 and 9). As shown in FIG. 7, the cooling water flows into the chamber 3 of the female element 1 through the tube 21 and the metal sleeve 15 and then into the chamber 3' of the male element 1' through the ducts 4, the gap 41 and the ducts 4'. The cooling water then flows in the direction of the tool head or the induction coil (not shown) through the tube 21'. The cooling water flows around the electric lines 28, 28' and, in particular, the housing parts in which the electric contact sockets 23 and the contact pins 38 are situated, and thus continuously cools the electric lines. The backflow of heated cooling water from the induction coil after it is cooled to the cooling water tank (not shown) flows through the tube 20', the metal sleeve 31, the bore 5, the metal sleeve 14 in the female element and the tube 20 without passing through the chambers 3, 3' and the ducts 4, 4'. It should be appreciated that the heated cooling water does not mix with the cooling water being supplied, to facilitate recooling.

Advantageously, a plug-and-socket connection for the coolant circuit and the electric circuit is created that can be easily and rapidly actuated without the aid of special wrenches. In addition, the plug-and-socket connection is impervious to leakage while providing functional reliability, strength, durability and insensitivity to external mechanical influences. It should be appreciated that the connection between the two elements of the plug-and-socket connection may be reinforced by an additional means, e.g., with a retaining ring having a locking mechanism such as a bayonet lock or a screw-type lock and is secured to the periphery of one element.

Figure 10:
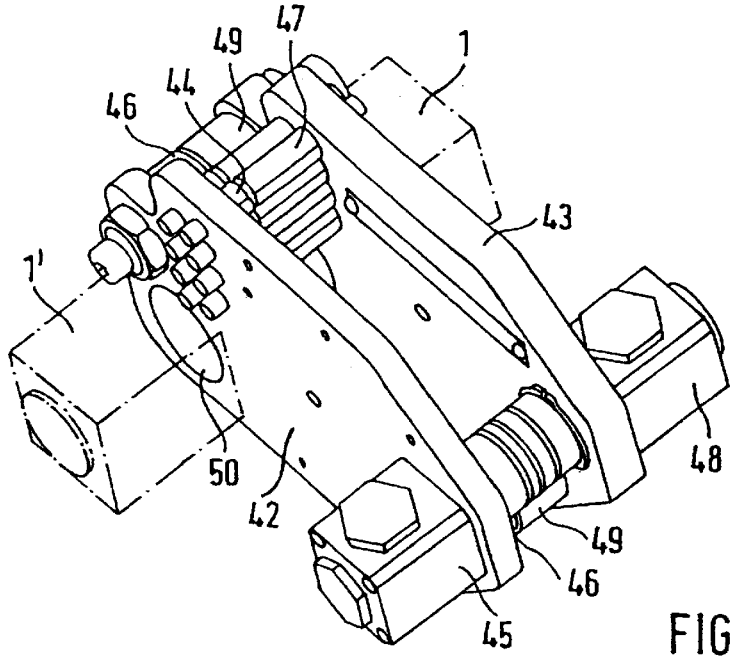
FIG. 10 is an oblique view of a tool change system that contains plug-and-socket connections according to the present invention.

Referring to FIG. 10, another example of installation of the plug-and-socket connection in combination with another supply connection for a tool, e.g., a robotic tool, is illustrated. In this example, the sockets and plugs for various supply lines are rigidly mounted in corresponding recesses and bores of two opposed carrier plates 42 and 43. A row of connection plugs 44, a pin housing 45 and two guide columns 46 are disposed on the carrier plate 42 on the consumer side, with the corresponding connection sockets, 47, a socket housing 48 and two guide bushings 49 disposed on the carrier plate 43 on the supply side. In addition, both carrier plates 42, 43 include a bore 50. The male element 1' of a plug-and-socket connection according to the invention may be mounted in the bore 50 on the consumer side, and the female element 1 may be mounted in the bore on the supply side, as indicated by dot-dash lines in FIG. 10. Mounting rings 51, 51' of metal are disposed in annular grooves located on the circumference of the housings 2 and 2', as shown in FIGS. 1, 2, 7 and 9. The elements are secured within the bores 50 of the carrier plate 42, 43 by the mounting rings. Advantageously, a compact and functionally reliable multi-plug connection is provided that can be manually actuated in a simple and rapid fashion if the tool requires maintenance or replacement.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A plug-and-socket connection for water-cooled, current-bearing lines for bipolar high-frequency current conductors used for the induction heating of tools, comprising:

a female element having a housing;

a chamber disposed within said female element housing;

at least one duct for transporting incoming cooling water opening into said female element chamber;

a water tube connected to said female element chamber, wherein said water tube transports cooling water for cooling the plug-and-socket connection;

a male element having a housing, wherein said male element is operatively connected to said female element;

a chamber disposed within said male element housing;

at least one duct for transporting incoming cooling water opening into said male element chamber, wherein said female element ducts are operatively connected to said male element ducts in the interconnected state of the plug-and-socket connection;

a water tube connected to said male element chamber, wherein said water tube transports cooling water for the plug-and-socket connection;

wherein said male element water tube and said female element water tube are interconnected to provide a backflow of the cooling water between said male element water tube to supply cooling water to said male element and said female element water tube to transport the cooling water away from said female element, such that said interconnection bypasses said female element and said male element chambers;

a contact socket for an electric bipolar plug-and-socket connection mounted in said female element housing, wherein said female element housing includes a bore adjacent to said duct, and said contact socket is disposed within the contact socket bore;

a contact pin of said male element corresponds to said contact socket, wherein said contact pin projects from an end face of said male element housing into a bore in said male element housing adjacent to the ducts; and an electric line for supplying power electrically connected to said contact sockets and said contact pins, wherein said electric line is guided therethrough said male and female element water tubes that supply and convey away the cooling water.

2. A plug-and-socket connection as set forth in claim 1, wherein said male element housing and said female element housing each contain three ducts, wherein said ducts are arranged 120° apart, such that said female element ducts are aligned with said male element ducts in the interconnected state of the plug-and-socket connection, and the bores for the electric contact sockets and the electric contact pins and the bore for the connections of the water backflow, are also offset relative to one another by 120°, and are respectively arranged between said ducts.

3. A plug-and-socket connection as set forth in claim 1, wherein said electric lines, which are guided inside said water tubes that supply and convey away the cooling water and said shorter metal tubes that open into said chambers and are connected to said water tubes, include six wires divided into two groups of three wires each that are electrically connected to said contact sockets and said contact pins respectively, at said female and male element chambers.

4. A plug-and-socket connection as set forth in claim 1 further comprising:

a mounting ring disposed in annular grooves on both said female element housing and said male element housing to maintain connection of said female element and said male element when the plug-and-socket connection is interconnected, and for mounting said female element and the male element onto a carrier plate.

5. A plug-and-socket connection as set forth in claim 1 further comprising a retaining ring having a locking mechanism to secure the connection of said female element and said male element when the plug-and socket-connection is interconnected.

6. A plug-and-socket connection as set forth in claim 5 wherein said locking mechanism is a bayonet lock or a screw-type lock.

7. A plug-and-socket connection as set forth in claim 1 further comprising:

a closure piece for sealing said female element chamber positioned relative to a housing wall, wherein said closure piece contains two openings;

a shorter metal sleeve disposed in one of the openings, wherein said shorter metal sleeve opens into said female element chamber;

a longer metal sleeve disposed in another one of the openings, wherein said longer metal sleeve extends through said female element chamber and into a bore in said female element housing positioned adjacent to the said female element chamber and aligned with said opening, wherein said female element water tubes for supply and backflow of cooling fluid fit onto an end of said metal sleeve that projects from said closure piece; and a clamp for securing said female element water tube onto said metal sleeve.

8. A plug-and-socket connection as set forth in claim 7, wherein the bore includes an inner bore defined by a step in a wall of the bore and an outer bore, and said longer metal sleeve in the female element extends into the inner bore section.

9. A plug-and-socket connection as set forth in claim 8 further comprising:

a closure piece for sealing said male element chamber positioned relative to a housing wall, wherein said closure piece contains two openings, a shorter metal sleeve disposed in one of the openings, wherein said shorter metal sleeve opens into said male element chamber, a longer metal sleeve disposed in another one of the openings, wherein said longer metal sleeve extends through said male element chamber and into a bore in said male element housing positioned adjacent to said male element chamber and aligned with the opening, wherein said male element water tubes for supply and backflow of cooling water fit onto an end of the metal sleeve that projects from said closure piece; and a clamp for securing said male element water tube onto said metal sleeve.

10. A plug-and-socket connection as set forth in claim 9, wherein an end of said longer metal sleeve on the male element projects a predetermined distance from the bore, and said projecting end fits into the outer bore section in said female element when the plug-and-socket connection is interconnected, and is sealed therein relative to the wall by a ring seal.

11. A plug-and-socket connection as set forth in claim 10, further comprising:

a tubular projection extending a predetermined distance beyond an end of said metal sleeve for said male element wherein said tubular projection fits over an end section of said female element housing when the plug-and-socket connection is interconnected;

an integrally formed contact pin projecting from an end face of the male element housing into said tubular projection; and a ring seal for sealing said tubular projection relative to an end face of the female element housing when the plug-and-socket connection is interconnected.

12. A plug-and-socket connection for a current-bearing line comprising:

a female element having a housing;

a chamber disposed within said female element housing;

at least one duct for transporting incoming cooling fluid opening into said female element chamber;

a fluid tube connected to said female element chamber, wherein said fluid tube transports cooling fluid for cooling the plug-and-socket connection;

a male element having a housing, wherein said male element is operatively connected to said female element;

a chamber disposed within said male element housing;

at least one duct for transporting incoming cooling fluid opening into said male element chamber, wherein said female element ducts are operatively connected to said male element ducts in the interconnected state of the plug-and-socket connection;

a fluid tube connected to said male element chamber, wherein said fluid tube transports cooling fluid for the plug-and-socket connection;

wherein said male element fluid tube and said female element fluid tube are interconnected to provide a backflow of the cooling fluid between said male element fluid tube to supply cooling fluid to said male element and said female element fluid tube to transport the cooling fluid away from said female element, such that said interconnection bypasses said female element and said male element chambers;

a contact socket for a plug-and-socket connection mounted in said female element housing, wherein said female element housing includes a bore adjacent to said duct, and said contact socket is disposed within the contact socket bore;

a contact pin of said male element corresponding to said contact socket, wherein said contact pin projects from an end face of said male element housing into a bore in said male element housing adjacent to the ducts; and an electric line for supplying power electrically connected to said contact sockets and said contact pins, wherein said electric line is guided therethrough the male and female element fluid tubes that supply and convey away the cooling fluid.

13. A plug-and-socket connection as set forth in claim 12 wherein the cooling fluid is water.

14. A plug-and-socket connection as set forth in claim 12, wherein said electric lines include six wires divided into two groups of three wires each that are electrically connected to said contact sockets and said contact pins respectively, at the female and male element chambers.

15. A plug-and-socket connection as set forth in claim 12 further comprising:

a mounting ring disposed in annular grooves on both said female element housing and male element housing to securely connect said female element and said male element when the plug-and-socket connection is interconnected, and for mounting the female element and the male element onto a carrier plate.

16. A plug-and-socket connection as set forth in claim 12 further comprising:

a closure piece for sealing said female element chamber positioned relative to a housing wall, wherein said closure piece contains two openings;

a shorter metal sleeve disposed in one of the openings, wherein said shorter metal sleeve opens into said female element chamber;

a longer metal sleeve disposed in another one of the openings, wherein said longer metal sleeve extends through said female element chamber and into a bore in said female element housing positioned adjacent to the said female element chamber and aligned with said opening, wherein said female element fluid tubes for supply and backflow of cooling fluid fit onto an end of said metal sleeve that projects from said closure piece.

17. A plug-and-socket connection as set forth in claim 16, further comprising a clamp for securing said female element fluid tube onto said metal sleeve.

18. A plug-and-socket connection as set forth in claim 16, wherein the bore includes an inner bore defined by a step in a wall of the bore and an outer bore, and said longer metal sleeve in the female element extends into the inner bore.

19. A plug-and-socket connection as set forth in claim 12 further comprising:

a closure piece for sealing said male element chamber positioned relative to a housing wall, wherein said closure piece contains two openings, a shorter metal sleeve disposed in one of the openings, wherein said shorter metal sleeve opens into said male element chamber, a longer metal sleeve disposed in another one of the openings, wherein said longer metal sleeve extends through said male element chamber and into a bore in said male element housing positioned adjacent to said male element chamber and aligned with said opening, wherein said male element fluid tubes for supply and backflow of cooling fluid fit onto an end of the metal sleeve that projects from said closure piece.

20. A plug-and-socket connection as set forth in claim 19 further comprising a clamp for securing said male element fluid tube onto said metal sleeve.

21. A plug-and-socket connection as set forth in claim 19, wherein an end of said longer metal sleeve on the male element projects a predetermined distance from the bore, and said projecting end fits into the outer bore section in the female element when the plug-and-socket connection is interconnected.

22. A plug-and-socket connection as set forth in claim 21 further comprising a ring seal for sealing said longer metal sleeve within the bore.

23. A plug-and-socket connection as set forth in claim 21, further comprising:

a tubular projection extending a predetermined distance beyond an end of said metal sleeve for said male element wherein said tubular projection fits over an end of said female element housing when the plug-and-socket connection is interconnected; and an integrally formed contact pin projecting from the end face of said male element housing into said tubular projection.

24. A plug-and-socket connection as set forth in claim 23 further comprising a ring seal for sealing said tubular projection relative to an end face of the female element housing when the plug-and-socket connection is interconnected.

25. A plug-and-socket connection as set forth in claim 12, wherein said male element housing and said female element housing each contain three ducts, such that said female element ducts are aligned with said male element ducts in the interconnected state of the plug-and-socket connection.

26. A plug-and-socket connection as set forth in claim 25, wherein said ducts are arranged 120° apart.

27. A plug-and-socket connection as set forth in claim 26 wherein the bores for the electric contact sockets and the electric contact pins and the bore for the connections of the water backflow, are offset relative to one another by 120°, and are respectively arranged between said ducts.

28. A plug-and-socket connection as set forth in claim 12 further comprising a retaining ring having a locking mechanism to secure the connection of said female element and said male element when the plug-and socket-connection is interconnected.

29. A plug-and-socket connection as set forth in claim 28 wherein said locking mechanism is a bayonet lock or a screw-type lock.

* * * * *